US009051826B2

(12) United States Patent
Shaw et al.

(10) Patent No.: US 9,051,826 B2
(45) Date of Patent: Jun. 9, 2015

(54) DOWNHOLE CONTROL SYSTEM HAVING A VERSATILE MANIFOLD AND METHOD FOR USE OF SAME

(71) Applicant: Halliburton Energy Services, Inc., Houston, TX (US)

(72) Inventors: Joel David Shaw, Houston, TX (US); Michael Robert Konopczynski, Spring, TX (US); Paul R. Terry, Spring, TX (US); Timothy R. Tips, Montgomery, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/064,963

(22) Filed: Oct. 28, 2013

(65) Prior Publication Data

US 2014/0208729 A1 Jul. 31, 2014

(30) Foreign Application Priority Data

Jan. 28, 2013 (WO) ..... PCT/US2013/023466

(51) Int. Cl.
*E21B 34/10* (2006.01)
*E21B 43/14* (2006.01)

(52) U.S. Cl.
CPC ..... *E21B 43/14* (2013.01); *E21B 34/102* (2013.01); *E21B 34/10* (2013.01)

(58) Field of Classification Search
CPC ..... E21B 34/10; E21B 34/102
USPC ..... 166/375; 91/525, 526, 536
See application file for complete search history.

(56) References Cited

U.S. PATENT DOCUMENTS

| | | | | |
|---|---|---|---|---|
| 4,660,647 | A | 4/1987 | Richart | |
| 6,179,052 | B1 * | 1/2001 | Purkis et al. | 166/375 |
| 6,298,919 | B1 | 10/2001 | Browne et al. | |
| 6,516,888 | B1 * | 2/2003 | Gunnarson et al. | 166/375 |
| 7,182,139 | B2 * | 2/2007 | Rayssiguier et al. | 166/374 |
| 7,857,061 | B2 * | 12/2010 | Richards | 166/373 |
| 2006/0162935 | A1 | 7/2006 | MacDougall | |
| 2009/0321078 | A1 | 12/2009 | Wolters | |
| 2010/0236790 | A1 | 9/2010 | Smithson | |
| 2011/0290504 | A1 | 12/2011 | Purkis | |

OTHER PUBLICATIONS

International Search Report and Written Opinion; KIPO, PCT/2013/023466; Sep. 25, 2013.

* cited by examiner

*Primary Examiner* — F. Daniel Lopez

(57) ABSTRACT

A downhole control system for actuating hydraulically controlled devices positioned in a well. The system includes a first set of N hydraulically controlled devices positioned in the well and a second set of at least one hydraulically controlled device positioned in the well. A common control line is ported to a first side of each of the hydraulically controlled devices in the first set. N control lines are each ported to a second side of one of the hydraulically controlled devices in the first set. A first control line of the N control lines is ported to a first side of a first hydraulically controlled device of the second set and a second control line of the N control lines is ported to a second side of the first hydraulically controlled device of the second set, such that N+1 control lines are operable to actuate N+1 hydraulically controlled devices.

16 Claims, 4 Drawing Sheets

DOWNHOLE CONTROL SYSTEM HAVING A VERSATILE MANIFOLD AND METHOD FOR USE OF SAME

CROSS-REFERENCE TO RELATED APPLICATIONS

This application claims the benefit under 35 U.S.C. §119 of the filing date of International Application No. PCT/US2013/023466, filed Jan. 28, 2013.

TECHNICAL FIELD OF THE INVENTION

This invention relates, in general, to equipment utilized in conjunction with operations performed in relation to subterranean wells and, in particular, to a downhole control system and method having a versatile manifold operable to actuate at least N+1 hydraulically controlled devices with N+1 control lines.

BACKGROUND OF THE INVENTION

Without limiting the scope of the present invention, its background is described with reference to a downhole control system operating in a wellbore that traverses a hydrocarbon bearing subterranean formation, as an example.

It is well known in the subterranean well production art that production of hydrocarbon fluids can be improved by installing well monitoring equipment and completion components that can be adjusted during the life of the well. For example, certain well installations may include some combination of zonal isolation devices, interval control devices, downhole control systems, permanent monitoring systems, surface control and monitoring systems, distributed temperature sensing systems, data acquisition and management software and system accessories.

Once production begins, data from the well monitoring equipment can be used, for example, to regulate downhole flow control devices to control production from the various zones. Using a plurality of flow control devices allows an operator to selectively receive or restrict production from the different zones by opening, closing or choking flow through specific flow control devices. Typically, the actuation of such flow control devices may be accomplished with a hydraulic control system. In one implementation, each flow control device has two control lines associated therewith, one acting on either side of the actuation piston to open, close and partially close the flow control device. In this implementation, if there are three flow control devices in the completion, six control lines are required. In a more recent implementation, a common control line is associated with one port of each of the flow control devices with individual controls lines being run to the other port of each of the flow control devices. This implementation is known as an N+1 control system wherein N is the number individual control lines that run to the flow control devices and the plus 1 refers to the common control line. In this implementation, if there are three flow control devices in the completion, four control lines are required.

Regardless of the exact hydraulic control system implementation, it has been found that there is often a limitation on the number of control line penetrations that can be made, for example, at the wellhead, the tubing hanger, the production packer or through other well equipment. As such, the number of flow control devices or other hydraulically controlled devices in a completion is limited to no more than half the number of control line penetrations in a two control line implementation. Similarly, the number of flow control devices or other hydraulically controlled devices in a completion is limited to no more than one less than the number of control line penetrations in an N+1 implementation.

A need has therefore arisen for an improved downhole control system for actuating hydraulically controlled devices positioned in a well that enables control over a greater number of hydraulically controlled devices with a limited number of control lines.

SUMMARY OF THE INVENTION

The present invention disclosed herein is directed to a downhole control system and method utilizing a versatile manifold operable to actuate at least N+1 hydraulically controlled devices with N+1 control lines.

In one aspect, the present invention is directed to a downhole control system for actuating hydraulically controlled devices positioned in a well. The system includes a first set of N hydraulically controlled devices positioned in the well and a second set of at least one hydraulically controlled device positioned in the well. A common control line is ported to a first side of each of the hydraulically controlled devices in the first set. N control lines are each ported to a second side of one of the hydraulically controlled devices in the first set. A first control line of the N control lines is ported to a first side of a first hydraulically controlled device of the second set and a second control line of the N control lines is ported to a second side of the first hydraulically controlled device of the second set, such that N+1 control lines are operable to actuate N+1 hydraulically controlled devices.

In one embodiment, hydraulic pressure in the common control line prevents actuation of the hydraulically controlled devices in the first set while hydraulic pressure in the first and second control lines actuates the first hydraulically controlled device of the second set. In certain embodiments, a control valve may be positioned between the first and second control lines and the first hydraulically controlled device of the second set. In such embodiments, the control valve may be operable to allow and prevent actuation of the first hydraulically controlled device of the second set responsive to hydraulic pressure in the first and second control lines. The control valve may be operated responsive to hydraulic pressure in one of the first and second control lines, responsive to hydraulic pressure in a third control line of the N control lines or responsive to hydraulic pressure in the common control line. In some embodiments, hydraulic pressure in one of the first and second control lines may be used to prevent operation of the control valve.

In one embodiment, the hydraulic pressure required to actuate the first hydraulically controlled device of the second set may be greater than the hydraulic pressure required to actuate the hydraulically controlled devices of the first set ported to the first and second control lines. In certain embodiments, the first hydraulically controlled device of the second set may include a locking mechanism operable to prevent actuation of the first hydraulically controlled device of the second set. The locking mechanism may be operated responsive to hydraulic pressure in a third control line of the N control lines. In some embodiments, a third control line of the N control lines may be ported to a first side of a second hydraulically controlled device of the second set and a fourth control line of the N control lines may be ported to a second side of the second hydraulically controlled device of the second set, such that N+1 control lines are operable to actuate N+2 hydraulically controlled devices.

In another aspect, the present invention is directed to a downhole control system for actuating hydraulically controlled devices positioned in a well. The system includes a first set of N hydraulically controlled devices positioned in the well and a second set of at least one hydraulically controlled device positioned in the well. A common control line is ported to a first side of each of the hydraulically controlled devices in the first set. N control lines are each ported to a second side of one of the hydraulically controlled devices in the first set. In a first configuration, a first control line of the N control lines is ported to a first side of a first hydraulically controlled device of the second set and is also ported to one of the hydraulically controlled devices in the first set and a second control line of the N control lines is ported to a second side of the first hydraulically controlled device of the second set and is also ported to one of the hydraulically controlled devices in the first set. In a second configuration, the first control line is not ported to the first side of the first hydraulically controlled device of the second set but is ported to one of the hydraulically controlled devices in the first set and the second control line is not ported to the second side of the first hydraulically controlled device of the second set but is ported to one of the hydraulically controlled devices in the first set, such that N+1 control lines are operable to actuate N+1 hydraulically controlled devices.

In one embodiment, a control valve positioned between the first and second control lines and the first hydraulically controlled device of the second set is operable to shift the downhole control system from the first configuration to the second configuration. The control valve may be operated responsive to hydraulic pressure in one of the first and second control lines or responsive to hydraulic pressure in a third control line of the N control lines. In some embodiments, hydraulic pressure in one of the first and second control lines may be used to prevent operation of the control valve.

In a further aspect, the present invention is directed to a downhole control system for actuating hydraulically controlled devices positioned in a well. The system includes a first set of N hydraulically controlled devices positioned in the well and a second set of at least one hydraulically controlled device positioned in the well. A common control line is ported to a first side of each of the hydraulically controlled devices in the first set. N control lines are each operable to be ported to a second side of one of the hydraulically controlled devices in the first set. In a first configuration, a first control line of the N control lines is ported to a first side of a first hydraulically controlled device of the second set but is not ported to one of the hydraulically controlled devices in the first set and a second control line of the N control lines is ported to a second side of the first hydraulically controlled device of the second set but is not ported to one of the hydraulically controlled devices in the first set. In a second configuration, the first control line is not ported to the first side of the first hydraulically controlled device of the second set but is ported to one of the hydraulically controlled devices in the first set and the second control line is not ported to the second side of the first hydraulically controlled device of the second set but is ported to one of the hydraulically controlled devices in the first set, such that N+1 control lines are operable to actuate N+1 hydraulically controlled devices.

In one embodiment, a control valve positioned between the first and second control lines and the first hydraulically controlled device of the second set is operable to shift the downhole control system from the first configuration to the second configuration. The control valve may be operated responsive to hydraulic pressure in the common control line.

In yet another aspect, the present invention is directed to a downhole control method for actuating hydraulically controlled devices positioned in a well. The method includes positioning a first set of N hydraulically controlled devices in the well; positioning a second set of at least one hydraulically controlled device in the well; porting a common control line to a first side of each of the hydraulically controlled devices in the first set; porting each one of N control lines to a second side of one of the hydraulically controlled devices in the first set; porting a first control line of the N control lines to a first side of a first hydraulically controlled device of the second set; porting a second control line of the N control lines to a second side of the first hydraulically controlled device of the second set; and actuating N+1 hydraulically controlled devices responsive to hydraulic pressure variations in the N+1 control lines.

The method may also include preventing actuation of the hydraulically controlled devices in the first set responsive to hydraulic pressure in the common control line while actuating the first hydraulically controlled device of the second set responsive to hydraulic pressure in the first and second control lines; operating a control valve positioned between the first and second control lines and the first hydraulically controlled device of the second set to prevent hydraulic pressure in the first and second control lines from actuating the first hydraulically controlled device of the second set; requiring the hydraulic pressure to actuate the first hydraulically controlled device of the second set to be greater than the hydraulic pressure required to actuate the hydraulically controlled devices of the first set ported to the first and second control lines; operating a locking mechanism positioned in the first hydraulically controlled device of the second set to prevent hydraulic pressure in the first and second control lines from actuating the first hydraulically controlled device of the second set and/or porting a third control line of the N control lines to a first side of a second hydraulically controlled device of the second set, porting a fourth control line of the N control lines to a second side of the second hydraulically controlled device of the second set and actuating N+2 hydraulically controlled devices responsive to hydraulic pressure variations in the N+1 control lines.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts, which can be embodied in a wide variety of specific contexts. The specific embodiments discussed herein are merely illustrative of specific ways to make and use the invention, and do not delimit the scope of the present invention.

Figure 1:
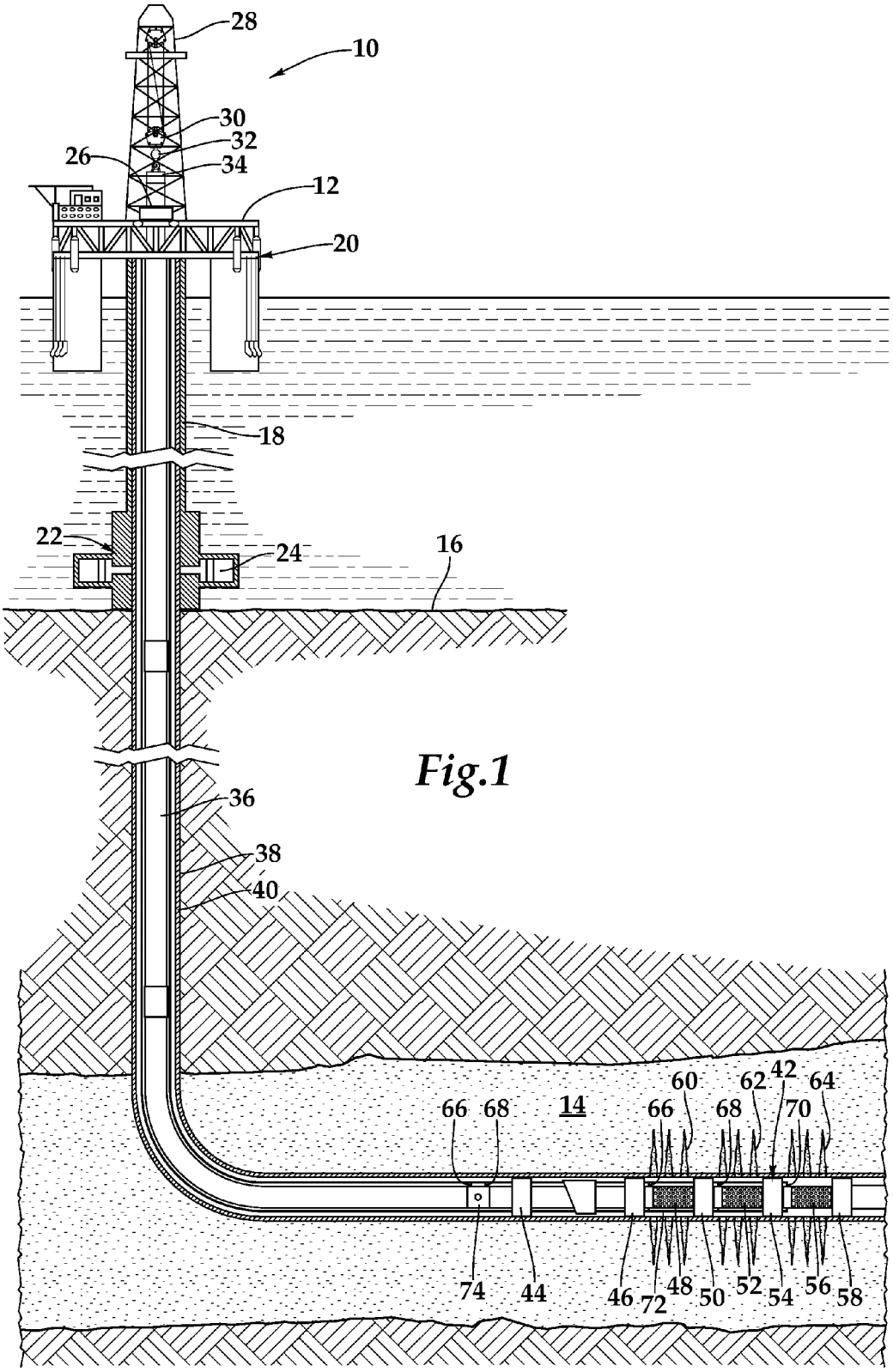
FIG. 1 is a schematic illustration of an offshore platform installing a completion including a downhole control system having a versatile manifold according to an embodiment of the present invention.

Referring initially to FIG. 1, a completion assembly having a versatile manifold is being installed in a well from an offshore oil or gas platform that is schematically illustrated and generally designated 10. A semi-submersible platform 12 is centered over submerged oil and gas formation 14 located below sea floor 16. A subsea conduit 18 extends from deck 20 of platform 12 to wellhead installation 22, including blowout preventers 24. Platform 12 has a hoisting apparatus 26, a derrick 28, a travel block 30, a hook 32 and a swivel 34 for raising and lowering pipe strings, such as a substantially tubular, axially extending tubular string 36.

A wellbore 38 extends through the various earth strata including formation 14 and has a casing string 40 cemented therein. Disposed in a substantially horizontal portion of wellbore 38 is a completion assembly 42 that includes various tools such as upper packer 44, packer 46, sand control screen and fluid flow control assembly 48, packer 50, sand control screen and fluid flow control assembly 52, packer 54, sand control screen and fluid flow control assembly 56 and packer 58. Packers 46, 50, 54, 58 divide the completion interval into three zones; namely, zones 60, 62, 64. As illustrated, one hydraulically controlled device; namely, sand control screen and fluid flow control assemblies 48, 52, 56 is disposed within each zone 60, 62, 64. Three control lines 66, 68, 70 extend from the surface and are ported to one side of an actuator in the respective hydraulically controlled devices 48, 52, 56. In addition, a common control line 72 that extends from the surface is ported to the other side of the actuator in each of the respective hydraulically controlled devices 48, 52, 56. Uphole of upper packer 44, completion assembly 42 includes a circulating valve 74 that is hydraulically operated to allow and prevent the circulation of fluid between the interior and the exterior of tubular string 36. In the illustrated embodiment, control line 66 is ported to one side of an actuator in circulating valve 74 and control line 68 is ported to the other side of the actuator in circulating valve 74. The common control line is not ported to circulating valve 74.

In the conventional N+1 control methodology, for N hydraulically controlled devices there is a requirement for N+1 control lines. One dedicate control line is ported to each of the hydraulically controlled devices and an addition common control line is port to each of the hydraulically controlled devices. For example, with respect to the above described hydraulically controlled devices 48, 52, 56 there is an N+1 control system consisting of control lines 66, 68, 70 and common control line 72. In the present invention, however, the N+1 control system is operable to actuate more than N hydraulically controlled devices. As illustrated and explained in greater detail below, control lines 66, 68, 70 and common control line 72 form a versatile manifold that is operable to actuate not only hydraulically controlled devices 48, 52, 56 but also hydraulically controlled device 74.

Even though FIG. 1 depicts a horizontal wellbore, it should be understood by those skilled in the art that the present invention is equally well suited for use in wellbores having other orientations including vertical wellbores, slanted wellbores, multilateral wellbores or the like. Accordingly, it should be understood by those skilled in the art that the use of directional terms such as above, below, upper, lower, upward, downward, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well, the downhole direction being toward the toe of the well. Also, even though FIG. 1 depicts an offshore operation, it should be understood by those skilled in the art that the present invention is equally well suited for use in onshore operations. Further, even though FIG. 1 depicts a cased hole completion, it should be understood by those skilled in the art that the present invention is equally well suited for use in open hole completions.

Figure 2:
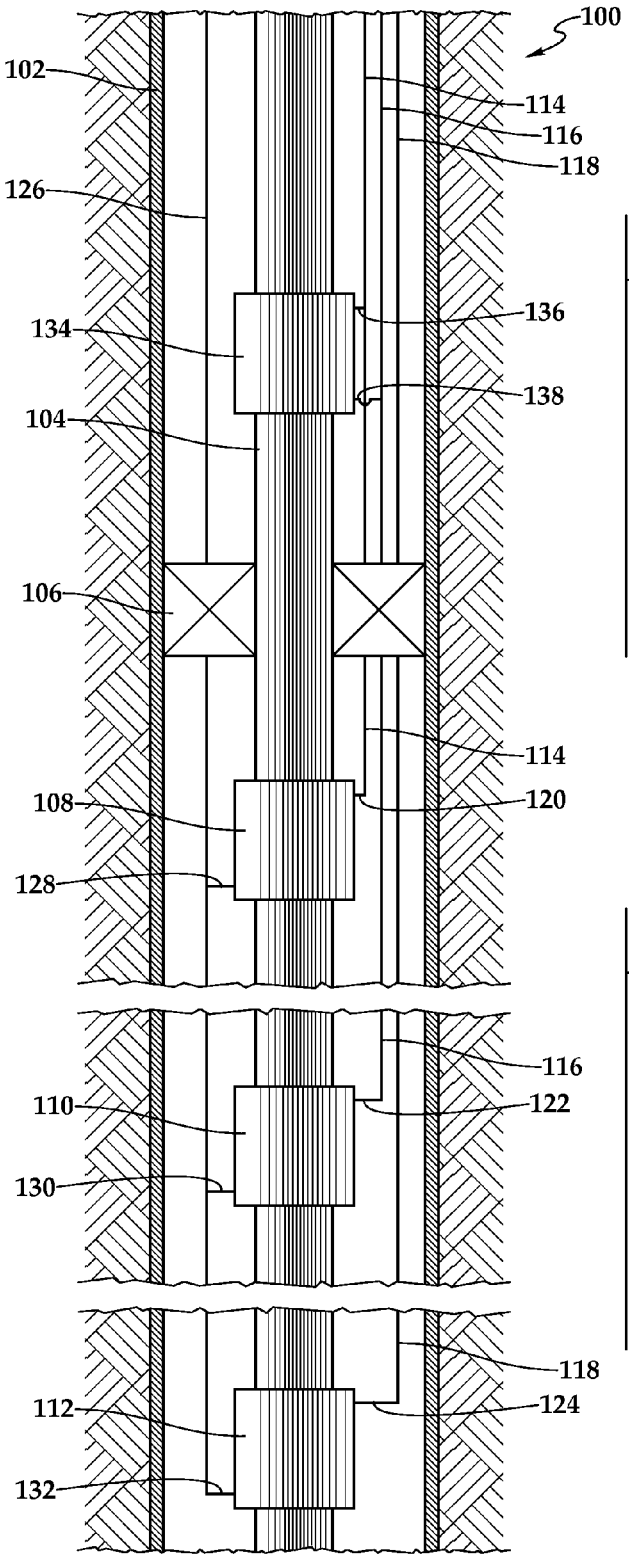
FIG. 2 is a schematic illustration of a well system including a downhole control system having a versatile manifold according to an embodiment of the present invention.

Referring next to FIG. 2, therein is depicted a downhole control system having a versatile manifold disposed within a well system that is schematically illustrated and generally designated 100. Well system 100 includes a casing string 102 have a tubing string 104 positioned therein. A packer 106 provides a sealing and gripping relationship between tubing string 104 and casing string 102. In the illustrated embodiment, tubing string 104 includes a first set of hydraulically controlled devices positioned in the well downhole of packer 106 depicted as hydraulically controlled devices 108, 110, 112, which may be the sand control screen and fluid flow control assemblies discussed above or any other type of hydraulically controlled device. Three control lines 114, 116, 118 extend from the surface and are ported to one side of an actuator in the respective hydraulically controlled devices 108, 110, 112 at connections 120, 122, 124. A common control line 126 that extends from the surface is ported to the other side of the actuator in each of the respective hydraulically controlled devices 108, 110, 112 at connections 128, 130, 132.

Tubing string 104 also includes a second set of hydraulically controlled devices positioned in the well uphole of packer 106 depicted as hydraulically controlled device 134, which may be the circulating valve discussed above or any other type of hydraulically controlled device. Control line 114 is ported to one side of an actuator in hydraulically controlled device 134 at connection 136. Control line 116 is ported to the other side of the actuator in hydraulically controlled device 134 at connection 138. Common control line 126 is not ported to hydraulically controlled device 134.

In the illustrated embodiment, control lines 114, 116, 118 represent the N control lines and common control line 126 represents the plus 1 control line. In this case, N+1 is a total of four control lines, which in a conventional N+1 control methodology could only be used to actuate N, or in this case three, hydraulically controlled devices. In the versatile manifold control methodology of the present invention, however, N+1 control lines are operable to actuate more than N hydraulically controlled devices. In the illustrated example, N+1 control lines are operable to actuate N+1 hydraulically controlled devices. Specifically, control lines 114, 116 are not only ported to hydraulically controlled devices 108, 110, respectively, but also to hydraulically controlled device 134.

In operation, hydraulically controlled device 134 may be actuated responsive to hydraulic pressure variation in control lines 114, 116. For example, a sufficient increase in the hydraulic pressure within control line 114 above that in control line 116 may cause hydraulically controlled device 134 to open and likewise, a sufficient increase in the hydraulic pressure within control line 116 above that in control line 114 may cause hydraulically controlled device 134 to close. Depending upon the type of component represented by hydraulically controlled device 134, hydraulic pressure variation in control lines 114, 116 may cause hydraulically controlled device 134 to ratchet, cycle through a J-slot, move between selected positions or move among infinitely variable positions. During actuation of hydraulically controlled device 134 responsive to hydraulic pressure variation in control lines 114, 116, actuation of hydraulically controlled devices 108, 110, 112 is preferably prevented by pressuring up on common control line 126 to a sufficient pressure that exceeds that used to actuate hydraulically controlled device 134.

Hydraulically controlled devices 108, 110, 112 may be actuated responsive to hydraulic pressure variation in control lines 114, 116, 118 and common control line 126. For example, a sufficient increase in the hydraulic pressure within control line 114 above that in common control line 126 may cause hydraulically controlled device 108 to open and likewise, a sufficient increase in the hydraulic pressure within common control line 126 above that in control line 114 may cause hydraulically controlled device 108 to close. Similarly, a sufficient increase in the hydraulic pressure within control line 116 above that in common control line 126 may cause hydraulically controlled device 110 to open and likewise, a sufficient increase in the hydraulic pressure within common control line 126 above that in control line 116 may cause hydraulically controlled device 110 to close. Also, a sufficient increase in the hydraulic pressure within control line 118 above that in common control line 126 may cause hydraulically controlled device 112 to open and likewise, a sufficient increase in the hydraulic pressure within common control line 126 above that in control line 118 may cause hydraulically controlled device 112 to close. Depending upon the type of component represented by hydraulically controlled devices 108, 110, 112, hydraulic pressure variation in control lines 114, 116, 118 and common control line 126 may cause hydraulically controlled devices 108, 110, 112 to ratchet, cycle through a J-slot, move between selected positions or move among infinitely variable positions. During actuation of hydraulically controlled devices 108, 110, 112 responsive to hydraulic pressure variation in control lines 114, 116, 118 and common control line 126, actuation of hydraulically controlled device 134 is preferably prevented by requiring the pressure to actuate hydraulically controlled device 134 to be sufficiently higher than the pressure required to actuate hydraulically controlled devices 108, 110. In other words, pressuring up control lines 114, 116 to actuate hydraulically controlled devices 108, 110 will not result in actuation of hydraulically controlled device 134 as the actuation pressure for hydraulically controlled devices 108, 110 is less than the actuation pressure for hydraulically controlled device 134. In this manner, the versatile manifold of the present invention enables N+1 control lines to actuate N+1 hydraulically controlled devices.

Figure 3:
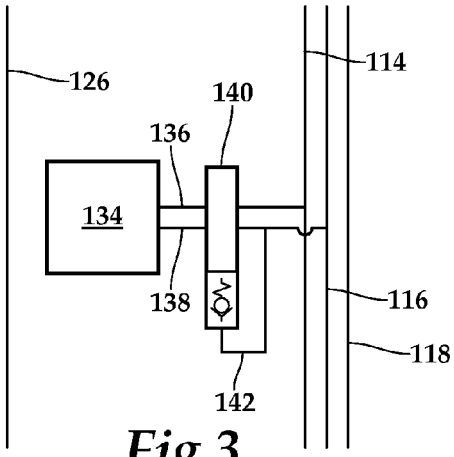
FIG. 3 is a schematic illustration of a downhole control system having a versatile manifold according to an embodiment of the present invention.

In some installation, after certain actuations of a particular hydraulically controlled device have been performed, further actuation of that hydraulically controlled device is not required. For example, in the configuration discussed above with reference to FIG. 1, following the completion process, further actuation of the circulating valve is no longer required. In such an installation, the versatile manifold of the present invention is operable to disable communication to a hydraulically controlled device that no longer requires actuation. Referring to FIG. 3, a control valve 140 has been added between control lines 114, 116 and hydraulically controlled device 134. A jumper line 142 has been tapped off control line 116 and routed to an input of control valve 140. Control valve 140 is operable to allow and prevent hydraulic pressure within control lines 114, 116 to be communicated to hydraulically controlled device 134. Specifically, in its open configuration, actuation of hydraulically controlled device 134 is responsive to hydraulic pressure variation in control lines 114, 116 in the manner discussed above with reference to FIG. 2. Once further actuation of hydraulically controlled device 134 is no longer required, hydraulic pressure within control line 116 and jumper line 142 is raised above a predetermined threshold sufficient to overcome, for example, the cracking force of a relief valve within control valve 140. The hydraulic pressure within control line 116 and jumper line 142 may then be used to shift a piston or similar component within control valve 140 to block further fluid communication between control lines 114, 116 and hydraulically controlled device 134. Thereafter, actuation of hydraulically controlled device 108, 110, 112 responsive to hydraulic pressure variation in control lines 114, 116, 118 and common control line 126 may proceed without the possibility of actuating hydraulically controlled device 134.

Figure 4:
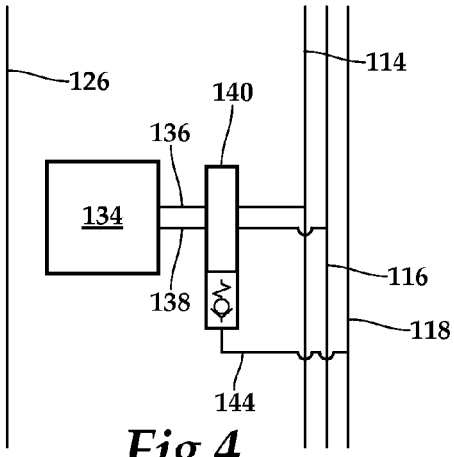
FIG. 4 is a schematic illustration of a downhole control system having a versatile manifold according to an embodiment of the present invention.

An alternate embodiment of the versatile manifold of the present invention operable to disable communication to a hydraulically controlled device that no longer requires actuation will now be discussed with referring to FIG. 4. A control valve 140 has been added between control lines 114, 116 and hydraulically controlled device 134. In addition, control line 118 has been ported to an input of control valve 140 via line 144. Control valve 140 is operable to allow and prevent hydraulic pressure within control lines 114, 116 to be communicated to hydraulically controlled device 134. Specifically, in its open configuration, actuation of hydraulically controlled device 134 is responsive to hydraulic pressure variation in control lines 114, 116 in the manner discussed above with reference to FIG. 2. Once further actuation of hydraulically controlled device 134 is no longer required, hydraulic pressure within control line 118 and line 144 is raised above a predetermined threshold sufficient to overcome, for example, the cracking force of a relief valve within control valve 140. The hydraulic pressure within control line 118 and line 144 may then be used to shift a piston or similar component within control valve 140 to block further fluid communication between control lines 114, 116 and hydraulically controlled device 134. Thereafter, actuation of hydraulically controlled devices 108, 110, 112 responsive to hydraulic pressure variation in control lines 114, 116, 118 and common control line 126 may proceed without the possibility of actuating hydraulically controlled device 134.

Figure 5:
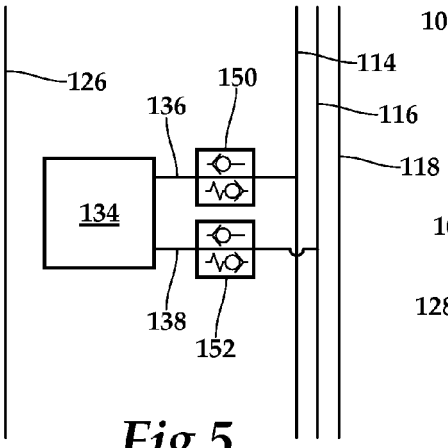
FIG. 5 is a schematic illustration of a downhole control system having a versatile manifold according to an embodiment of the present invention.

Referring now to FIG. 5, therein is depicted another embodiment of the versatile manifold of the present invention. As discussed above, during actuation of hydraulically controlled device 108, 110, 112 responsive to hydraulic pressure variation in control lines 114, 116, 118 and common control line 126, actuation of hydraulically controlled device 134 should be prevented. In this embodiment, a control valve 150 is positioned between control line 114 and hydraulically controlled device 134. Likewise, a control valve 152 is positioned between control line 116 and hydraulically controlled device 134. In this configuration, instead of increasing the actuation pressure of hydraulically controlled device 134, relief valves and check valves within control valves 150, 152 are used to establish a threshold pressure required to actuate hydraulically controlled device 134. As long as the cracking pressure of the relief valves is sufficiently higher than the pressure required to actuate hydraulically controlled device 108, 110 responsive to hydraulic pressure variation in control lines 114, 116 and common control line 126, hydraulically controlled device 134 will not be actuated during such operations.

Figure 6:
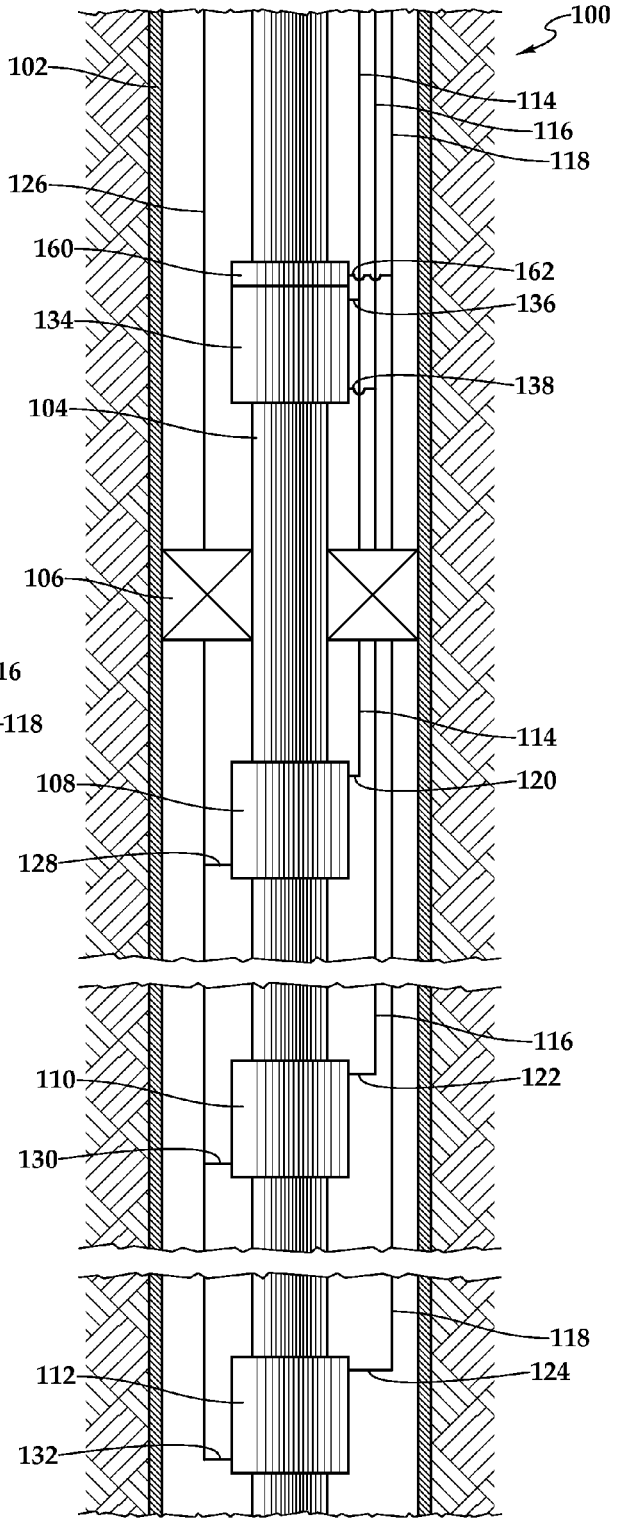
FIG. 6 is a schematic illustration of a well system including a downhole control system having a versatile manifold according to an embodiment of the present invention.

Referring now to FIG. 6, a locking mechanism 160 has been added to hydraulically controlled device 134. In addition, control line 118 has been ported to an input of locking mechanism 160 via line 162. Locking mechanism 160 is operable to allow or prevent movement of the actuator piston in hydraulically controlled device 134. In its disengaged configuration, actuation of hydraulically controlled device 134 is responsive to hydraulic pressure variation in control lines 114, 116 in the manner discussed above with reference to FIG. 2. Once further actuation of hydraulically controlled device 134 is no longer desired, hydraulic pressure within control line 118 and line 162 is raised above a predetermined threshold sufficient to engage locking mechanism 160. For example, locking mechanism 160 may be a pin or sleeve that is axially shifted or rotated or other device that operates to prevent movement of the actuator piston in hydraulically controlled device 134. Locking mechanism 160 is preferably operated responsive to hydraulic pressure within control line 118 and line 162. Thereafter, actuation of hydraulically controlled devices 108, 110, 112 responsive to hydraulic pressure variation in control lines 114, 116, 118 and common control line 126 may proceed without the possibility of actuating hydraulically controlled device 134.

Alternatively, a locking mechanism may be used that allows hydraulically controlled device 134 to be shifted from the closed position to the open position then back to the closed positioned one time. In this scenario, after hydraulically controlled device 134 is shifted from the open position to the closed position, hydraulically controlled device 134 would automatically be locked in the closed position without the requirement of hydraulically actuating the locking mechanism. Thereafter, actuation of hydraulically controlled devices 108, 110, 112 responsive to hydraulic pressure variation in control lines 114, 116, 118 and common control line 126 may proceed without the possibility of actuating hydraulically controlled device 134.

Figure 7:
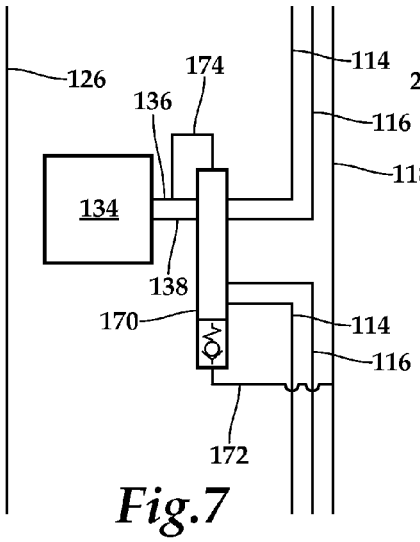
FIG. 7 is a schematic illustration of a downhole control system having a versatile manifold according to an embodiment of the present invention.

FIG. 7 depicts an embodiment of the versatile manifold of the present invention having discontinuous control lines 114, 116. A control valve 170 has been added between upper and lower sections of control lines 114, 116 and between control lines 114, 116 and hydraulically controlled device 134. In addition, control line 118 has been ported to an input of control valve 170 via line 172 and control line 114 is ported to another input of control valve 170 via jumper line 174. In a first configuration, control lines 114, 116 are ported to hydraulically controlled device 134 but are not ported to hydraulically controlled devices 108, 110 due to the discontinuity in control lines 114, 116. In this configuration, actuation of hydraulically controlled device 134 is responsive to hydraulic pressure variation in control lines 114, 116. Such hydraulic pressure variation, however, have no effect on hydraulically controlled devices 108, 110 as control lines 114, 116 are not ported to hydraulically controlled devices 108, 110. Once further actuation of hydraulically controlled device 134 is no longer required, hydraulic pressure within control line 118 and line 172 is raised above a predetermined threshold sufficient to overcome, for example, the cracking force of a relief valve within control valve 170. The hydraulic pressure within control line 118 and line 172 is used to shift an operating piston or similar component within control valve 170 to enable fluid communication between the upper and lower sections of control lines 114, 116 and disable fluid communication between control lines 114, 116 and hydraulically controlled device 134, thereby shifting the system to a second configuration. Thereafter, actuation of hydraulically controlled devices 108, 110, 112 responsive to hydraulic pressure variation in control lines 114, 116, 118 and common control line 126 may proceed without the possibility of actuating hydraulically controlled device 134.

This embodiment of the versatile manifold of the present invention has unique features enabled by control line 114 being ported to an input of control valve 170 via jumper line 174. Specifically, by maintaining sufficient hydraulic pressure on control line 114 and jumper line 174 while the system is in the first configuration, shifting of the operating piston within control valve 170 can be prevented. This allows pressure in control line 118 to be used, for example, to actuate hydraulically controlled device 112 without operating control valve 170. In addition, in certain implementations, once the system has been shifted to the second configuration, application of sufficient hydraulic pressure on control line 114 and jumper line 174 can be used to operate the system back to the first configuration.

Figure 8:
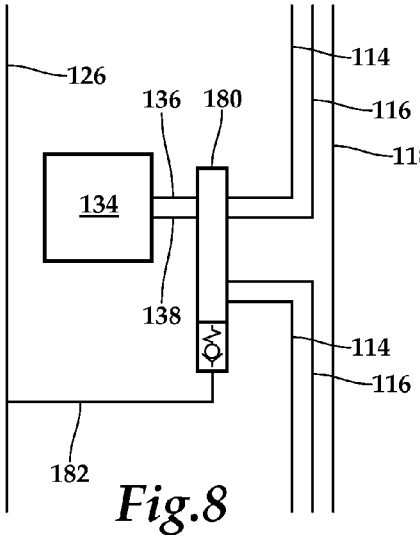
FIG. 8 is a schematic illustration of a downhole control system having a versatile manifold according to an embodiment of the present invention.

FIG. 8 depicts another embodiment of the versatile manifold of the present invention having discontinuous control lines 114, 116. A control valve 180 has been added between upper and lower sections of control lines 114, 116 and between control lines 114, 116 and hydraulically controlled device 134. In addition, common control line 126 has been ported to an input of control valve 180 via line 182. In a first configuration, control lines 114, 116 are ported to hydraulically controlled device 134 but are not ported to hydraulically controlled devices 108, 110 due to the discontinuity in control lines 114, 116. In this configuration, actuation of hydraulically controlled device 134 is responsive to hydraulic pressure variation in control lines 114, 116. Such hydraulic pressure variation, however, have no effect on hydraulically controlled devices 108, 110 as control lines 114, 116 are not ported to hydraulically controlled devices 108, 110. Once further actuation of hydraulically controlled device 134 is no longer required, hydraulic pressure within common control line 126 and line 182 is raised above a predetermined threshold sufficient to overcome, for example, the cracking force of a relief valve within control valve 180. The hydraulic pressure within common control line 126 and line 182 is used to shift an operating piston or similar component within control valve 180 to enable fluid communication between the upper and lower sections of control lines 114, 116 and disable fluid communication between control lines 114, 116 and hydraulically controlled device 134, thereby shifting the system to a second configuration. Thereafter, actuation of hydraulically controlled devices 108, 110, 112 responsive to hydraulic pressure variation in control lines 114, 116, 118 and common control line 126 may proceed without the possibility of actuating hydraulically controlled device 134.

Figure 9:
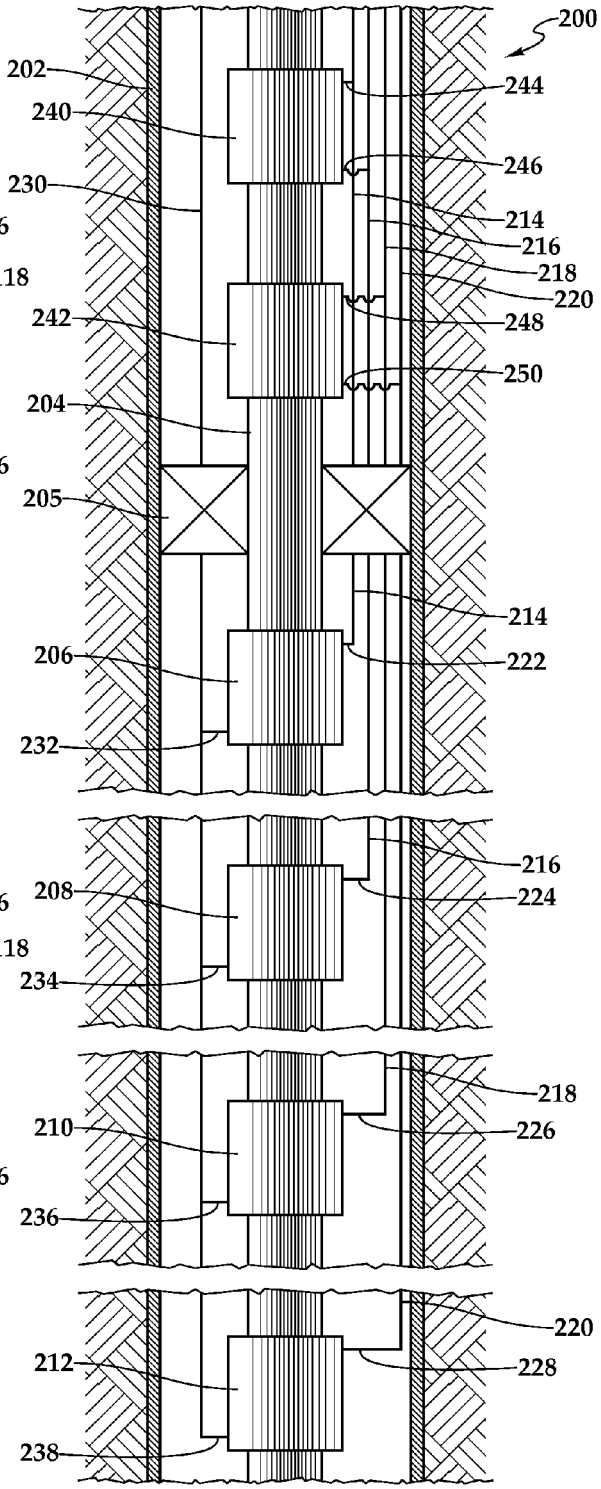
FIG. 9 is a schematic illustration of a well system including a downhole control system having a versatile manifold according to an embodiment of the present invention.

Referring next to FIG. 9, therein is depicted a downhole control system having a versatile manifold disposed within a well system that is schematically illustrated and generally designated 200. Well system 200 includes a casing string 202 have a tubing string 204 positioned therein. A packer 205 provides a sealing and gripping relationship between tubing string 204 and casing string 202. In the illustrated embodiment, tubing string 204 includes a first set of hydraulically controlled devices positioned in the well downhole of packer 205 depicted as hydraulically controlled devices 206, 208, 210, 212. Four control lines 214, 216, 218, 220 extend from the surface and are ported to one side of an actuator in the respective hydraulically controlled devices 206, 208, 210, 212 at connections 222, 224, 226, 228. A common control line 230 that extends from the surface is ported to the other side of the actuator in each of the respective hydraulically controlled devices 206, 208, 210, 212 at connections 232, 234, 236, 238.

Tubing string 204 also includes a second set of hydraulically controlled devices positioned in the well uphole of packer 205 depicted as hydraulically controlled devices 240, 242. Control line 214 is ported to one side of an actuator in hydraulically controlled device 240 at connection 244. Control line 216 is ported to the other side of the actuator in hydraulically controlled device 240 at connection 246. Control line 218 is ported to one side of an actuator in hydraulically controlled device 242 at connection 248. Control line 220 is ported to the other side of the actuator in hydraulically controlled device 242 at connection 250. Common control line 230 is not ported to hydraulically controlled devices 240, 242.

In the illustrated embodiment, control lines 214, 216, 218, 220 represent the N control lines and common control line 230 represents the plus 1 control line. In this case, N+1 is a total of five control lines, which in conventional N+1 control methodology could only be used to actuate N, or in this case four, hydraulically controlled devices. In the versatile manifold control methodology of the present invention, however, N+1 control lines are operable to actuate more than N hydraulically controlled devices. In the illustrated example, N+1 control lines are operable to actuate N+2 hydraulically controlled devices. Specifically, control lines 214, 216 are not only ported to hydraulically controlled devices 206, 208, respectively, but also to hydraulically controlled device 240. Likewise, control lines 218, 220 are not only ported to hydraulically controlled devices 210, 212, respectively, but also to hydraulically controlled device 242.

In operation, hydraulically controlled device 240 may be actuated responsive to hydraulic pressure variation in control lines 214, 216 and hydraulically controlled device 242 may be actuated responsive to hydraulic pressure variation in control lines 218, 220. During actuation of hydraulically controlled devices 240, 242 responsive to hydraulic pressure variation in control lines 214, 216, 218, 220 actuation of hydraulically controlled devices 206, 208, 210, 212 is preferably prevented by pressuring up on common control line 230 to a sufficient pressure that exceeds that used to actuate hydraulically controlled device 240, 242.

Hydraulically controlled devices 206, 208, 210, 212 may be actuated responsive to hydraulic pressure variation in control lines 214, 216, 218, 220 and common control line 230. During actuation of hydraulically controlled devices 206, 208, 210, 212 responsive to hydraulic pressure variation in control lines 214, 216, 218, 220 and common control line 230, actuation of hydraulically controlled devices 240, 242 is preferably prevented by requiring the actuation pressure of hydraulically controlled devices 240, 242 to be sufficiently higher than the actuation pressure of hydraulically controlled devices 206, 208, 210, 212. Alternatively or additionally, control valves or locking mechanisms such as those described above can be operated to prevent actuation of hydraulically controlled devices 240, 242. In this manner, the versatile manifold of the present invention enables N+1 control lines to actuate N+2 hydraulically controlled devices.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A downhole control system for actuating hydraulically controlled devices positioned in a well, the system comprising:

a first set of N hydraulically controlled devices positioned in the well;

a second set of at least one hydraulically controlled device positioned in the well;

a common control line ported to a first side of each of the hydraulically controlled devices in the first set; and N control lines each ported to a second side of one of the hydraulically controlled devices in the first set, wherein, a first control line of the N control lines is ported to a first side of a first hydraulically controlled device of the second set;

wherein, a second control line of the N control lines is ported to a second side of the first hydraulically controlled device of the second set;

wherein, during actuation of the first hydraulically controlled device of the second set responsive to pressure variations in the first and second control lines, actuation of the N hydraulically controlled devices of the first set is prevented by pressurizing the common control line to a pressure above that in the first and second control lines, such that N+1 control lines are operable to actuate at least N+1 hydraulically controlled devices; and wherein, a control valve positioned between the first and second control lines and the first hydraulically controlled device of the second set is operable to prevent hydraulic pressure in the first and second control lines from actuating the first hydraulically controlled device of the second set.

2. The downhole control system as recited in claim 1 wherein the control valve is operated responsive to hydraulic pressure in one of the first and second control lines.

3. The downhole control system as recited in claim 1 wherein the control valve is operated responsive to hydraulic pressure in a third control line of the N control lines.

4. The downhole control system as recited in claim 1 wherein the control valve is operated responsive to hydraulic pressure in the common control line.

5. The downhole control system as recited in claim 1 wherein the control valve is prevented from operating responsive to hydraulic pressure in one of the first and second control lines.

6. The downhole control system as recited in claim 1 wherein the hydraulic pressure required to actuate the first hydraulically controlled device of the second set is greater than the hydraulic pressure required to actuate the hydraulically controlled devices of the first set ported to the first and second N control lines.

7. The downhole control system as recited in claim 1 wherein a third control line of the N control lines is ported to a first side of a second hydraulically controlled device of the second set and wherein a fourth control line of the N control lines is ported to a second side of the second hydraulically controlled device of the second set, such that N+1 control lines are operable to actuate N+2 hydraulically controlled devices.

8. A downhole control system for actuating hydraulically controlled devices positioned in a well, the system comprising:

a first set of N hydraulically controlled devices positioned in the well;

a second set of at least one hydraulically controlled device positioned in the well;

a common control line ported to a first side of each of the hydraulically controlled devices in the first set; and N control lines each ported to a second side of one of the hydraulically controlled devices in the first set, wherein, a first control line of the N control lines is ported to a first side of a first hydraulically controlled device of the second set;

wherein, a second control line of the N control lines is ported to a second side of the first hydraulically controlled device of the second set; and wherein, during actuation of the first hydraulically controlled device of the second set responsive to pressure variations in the first and second control lines, actuation of the N hydraulically controlled devices of the first set is prevented by pressurizing the common control line to a pressure above that in the first and second control lines, such that N+1 control lines are operable to actuate at least N+1 hydraulically controlled devices wherein the first hydraulically controlled device of the second set further comprises a locking mechanism hydraulically movable between engaged and disengaged configurations and operable to prevent actuation of the first hydraulically controlled device of the second set when the locking mechanism is in the engaged configuration.

9. A downhole control system for actuating hydraulically controlled devices positioned in a well, the system comprising:

a first set of N hydraulically controlled devices positioned in the well;

a second set of at least one hydraulically controlled device positioned in the well;

a common control line ported to a first side of each of the hydraulically controlled devices in the first set; and N control lines each ported to a second side of one of the hydraulically controlled devices in the first set, wherein, in a first configuration, a first control line of the N control lines is ported to a first side of a first hydraulically controlled device of the second set and is ported to one of the hydraulically controlled devices in the first set and a second control line of the N control lines is ported to a second side of the first hydraulically controlled device of the second set and is ported to one of the hydraulically controlled devices in the first set such that during actuation of the first hydraulically controlled device of the second set responsive to pressure variations in the first and second control lines, actuation of the N hydraulically controlled devices of the first set is prevented by pressurizing the common control line to a pressure above that in the first and second control lines; and wherein, in a second configuration, the first control line is not ported to the first side of the first hydraulically controlled device of the second set and is ported to one of the hydraulically controlled devices in the first set and the second control line is not ported to the second side of the first hydraulically controlled device of the second set and is ported to one of the hydraulically controlled devices in the first set, such that N+1 control lines are operable to actuate at least N+1 hydraulically controlled devices.

10. The downhole control system as recited in claim 9 further comprising a control valve positioned between the first and second control lines and the first hydraulically controlled device of the second set, the control valve operable to shift the downhole control system from the first configuration to the second configuration.

11. The downhole control system as recited in claim 10 wherein the control valve is operated responsive to hydraulic pressure in one of the first and second control lines.

12. The downhole control system as recited in claim 10 wherein the control valve is operated responsive to hydraulic pressure in a third control line of the N control lines.

13. A downhole control method for actuating hydraulically controlled devices positioned in a well, the method comprising:

positioning a first set of N hydraulically controlled devices in the well;

positioning a second set of at least one hydraulically controlled device in the well;

porting a common control line to a first side of each of the hydraulically controlled devices in the first set;

porting each one of N control lines to a second side of one of the hydraulically controlled devices in the first set;

porting a first control line of the N control lines to a first side of a first hydraulically controlled device of the second set;

porting a second control line of the N control lines to a second side of the first hydraulically controlled device of the second set;

during actuation of the first hydraulically controlled device of the second set responsive to pressure variations in the first and second control lines, preventing actuation of the N hydraulically controlled devices of the first set by pressurizing the common control line to a pressure above that in the first and second control lines of the N control lines;

operating a control valve positioned between the first and second control lines and the first hydraulically controlled device of the second set to prevent hydraulic pressure in the first and second control lines from actuating the first hydraulically controlled device of the second set; and actuating at least N+1 hydraulically controlled devices responsive to hydraulic pressure variations in the N+1 control lines.

14. The method as recited in claim 13 further comprising requiring the hydraulic pressure to actuate the first hydraulically controlled device of the second set to be greater than the hydraulic pressure required to actuate the hydraulically controlled devices of the first set ported to the first and second control lines.

15. The method as recited in claim 13 further comprising porting a third control line of the N control lines to a first side of a second hydraulically controlled device of the second set, porting a fourth control line of the N control lines to a second side of the second hydraulically controlled device of the second set and actuating N+2 hydraulically controlled devices responsive to hydraulic pressure variations in the N+1 control lines.

16. A downhole control method for actuating hydraulically controlled devices positioned in a well, the method comprising:

positioning a first set of N hydraulically controlled devices in the well;

positioning a second set of at least one hydraulically controlled device in the well;

porting a common control line to a first side of each of the hydraulically controlled devices in the first set;

porting each one of N control lines to a second side of one of the hydraulically controlled devices in the first set;

porting a first control line of the N control lines to a first side of a first hydraulically controlled device of the second set;

porting a second control line of the N control lines to a second side of the first hydraulically controlled device of the second set;

during actuation of the first hydraulically controlled device of the second set responsive to pressure variations in the first and second control lines, preventing actuation of the N hydraulically controlled devices of the first set by pressurizing the common control line to a pressure above that in the first and second control lines of the N control lines;

actuating at least N+1 hydraulically controlled devices responsive to hydraulic pressure variations in the N+1 control lines; and operating a locking mechanism positioned in the first hydraulically controlled device of the second set by hydraulically moving the locking mechanism between engaged and disengaged configurations, wherein in the engaged configuration, hydraulic pressure in the first and second control lines is prevented from actuating the first hydraulically controlled device of the second set.

* * * * *